United States Patent [19]

Rosenberg

[11] 4,030,148

[45] June 21, 1977

[54] SWIMMING POOL SURFACE CLEANING DEVICE

[76] Inventor: Jeffrey Rosenberg, 1270 Stillwater Drive, Miami Beach, Fla. 33141

[22] Filed: May 17, 1976

[21] Appl. No.: 686,932

[52] U.S. Cl. ..... 4/172; 4/172.15; 4/172.16; 4/172.17; 15/1.7; 134/167 R

[51] Int. Cl.[2] ..... E04H 3/16; E04H 3/18; F16L 22/02

[58] Field of Search ..... 4/172, 172.15, 172.18, 4/172.17, 172.16; 15/1.7; 134/167 R, 168 R; 210/169, 121

[56] References Cited

UNITED STATES PATENTS

| | | | |
|---|---|---|---|
| 3,152,076 | 10/1964 | Krautzer | 4/172.17 X |
| 3,170,180 | 2/1965 | Winston | 15/1.7 |
| 3,244,284 | 4/1966 | Shaffer | 210/121 |
| 3,261,371 | 7/1966 | Vernon | 134/168 R |
| 3,509,584 | 5/1970 | Sable | 4/172 |
| 3,718,148 | 2/1973 | Gibellina | 134/167 R |
| 3,883,366 | 5/1975 | Blumenfeld | 134/167 R X |
| 3,926,667 | 12/1975 | Gibellina | 134/167 R |

*Primary Examiner*—Henry K. Artis

[57] ABSTRACT

A pool cleaning device which includes an arm having a proximal end mounted for swinging movement on a pool edge and a distal end which includes a spray facing towards the proximal end for urging water on the surface of a pool towards a skimmer and a mounting device to connect the proximal end of the device for swinging movement about the skimmer opening.

9 Claims, 4 Drawing Figures

SWIMMING POOL SURFACE CLEANING DEVICE

FIELD OF THE INVENTION

This invention relates to pool cleaning devices and, more particularly, to a pool cleaning device for urging floating debris towards an opening of a skimmer.

BACKGROUND OF THE INVENTION

As is perhaps well known, many pools include an opening which is arranged at about the normal water level of a pool and the skimmer is connected to the pool pump so that debris is trapped in it. One of the problems in the past has been that the debris does not flow rapidly towards the skimmer and this invention is of a device which can be mounted to the pool edge and it includes an arm which is of tubular material so that, from the distal end, a spray can be directed through an opening which faces the proximal end to urge debris on the surface of the pool toward the skimmer for more rapid cleaning of it.

It is, accordingly, an object of this invention to provide a pool cleaning device which includes an arm swingable with respect to a vertical axis and which has a distal end which extends well out over a pool and downwardly to the pool surface and in which there is an opening, so that, when water is directed through the arm, it will be ejected in a spray towards the distal end and the device also includes a means for pivotally mounting the proximal end to the pool edge for swinging movement about a location at which it is mounted above a pool skimmer opening.

In accordance with these and other objects which will become apparent hereinafter, the instant invention will now be described with reference to the accompanying drawings, which: whuch:

DESCRIPTION OF PREFERRED EMBODIMENT

Figure 1:
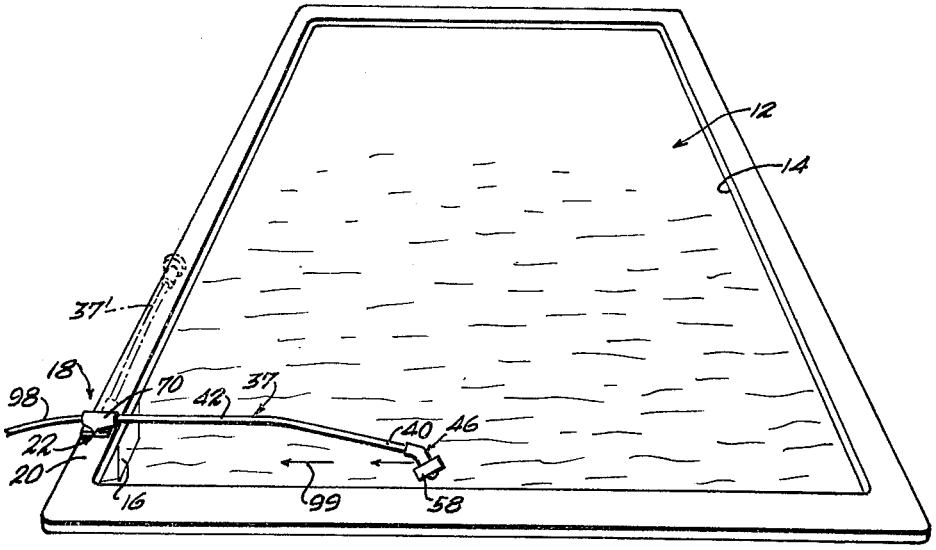
FIG. 1 is a perspective view of a pool having the instant invention mounted to the edge at about the opening of a skimmer arranged at the water level of the pool.

Referring to the drawings wherein like reference characters designate corresponding parts throughout the several views, a pool is generally designated by the numeral 12 which is filled to a normal water level 14. The pool is equipped with a conventional skimmer having an opening 16 at the normal water level. The device, which is generally designated by the numeral 18 is mounted to the edge 20. The device includes a support 22 which is fastened as by the bolts 24 and 26 to the pool edge. In the preferred embodiment a semi-spherical or dome-shaped hollow 30 is provided in the lower surface 32 of the support with a through opening 34 in the upper surface 35. In the preferred embodiment the upper surface includes a transverse rounded groove 36 thereacross, bisected by the through opening 34.

The device also includes an arm generally designated by the numeral 37 which extends outwardly and is connected at its proximal end zone 38 to the support.

The tubular arm includes a distal end zone 40 and an intermediate zone 42 which extends outwardly and downwardly between the proximal and distal end zones of the tubular arm. The arm extends downwardly so that the distal end zone is slightly above the normal waterline of the pool and the distal end zone is provided with an opening 44 which is smaller than the inside diameter of the tube and this opening faces inwardly toward the proximal end zone. Preferably a fitting 46 is provided which has a mouth 48 sized to fit over the terminal end 50 of the distal end zone and includes an angularly downwardly extending portion 52 terminating in a closed end 54 with an extending stud 56 to which a float 58 with a central through opening 60 is mounted and captivated by means of a bolt 62 in threaded engagement with the exterior or distal surface 66 of the float captivating it on the stud. The opening 44 may be a pattern of openings to direct a spray toward the proximal end.

With respect to the means to mount the proximal end, it may comprise a fitting 70 having a central recess 72 sized to receive the proximal end 38 therein with the terminal end 74 in close abutting relation with the shoulder 76 in the end wall 78 which has a through opening 80 and an extending portion 82 terminating in an enlarged rim 84 sized for receipt in the end of a hose to supply water. The distal end is rotatably mounted or journaled on a pivot pin 90 which extends downwardly from the fitting and through the opening 34 in the support and is captivated therein by a bolt 93 which is threadably engaged on the stud.

In use, waterflow is provided through a hose 98 and thence to the distal end where it is ejected in a spray indicated by the arrows 99 toward the mouth of the skimmer which urges debris toward it. The device may be rotated through an arc and stored as indicated by the dotted lines in FIG. 1. In the preferred embodiment a relatively rigid polyvinyl chloride material is utilized for the tubular length and the float means may be of any cellular material characterized by buoyancy including a disc of wood.

Figure 2:
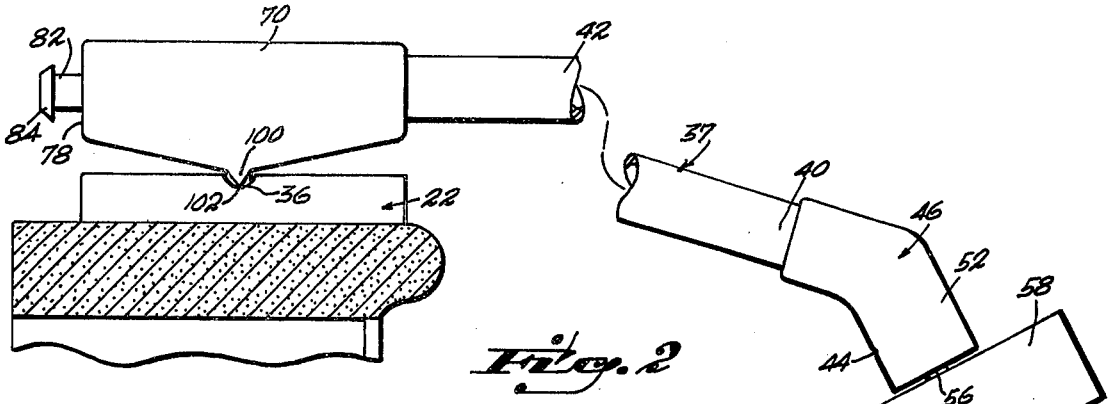
FIG. 2 is a vertical view of the lower left-hand portion of FIG. 1.

As best indicated in FIG. 2, a transverse, downwardly extending rib 100 is formed across the underside of fitting 70 for seated engagement in the groove 36. In a preferred embodiment, the rib 100 is generally triangular in cross section to define a bottom knife edge 102 which engages in said groove 36 to loosely maintain the arm 37 in the normal operating position as in FIGS. 1, 2 and 3 by gravity forces.

Figure 3:
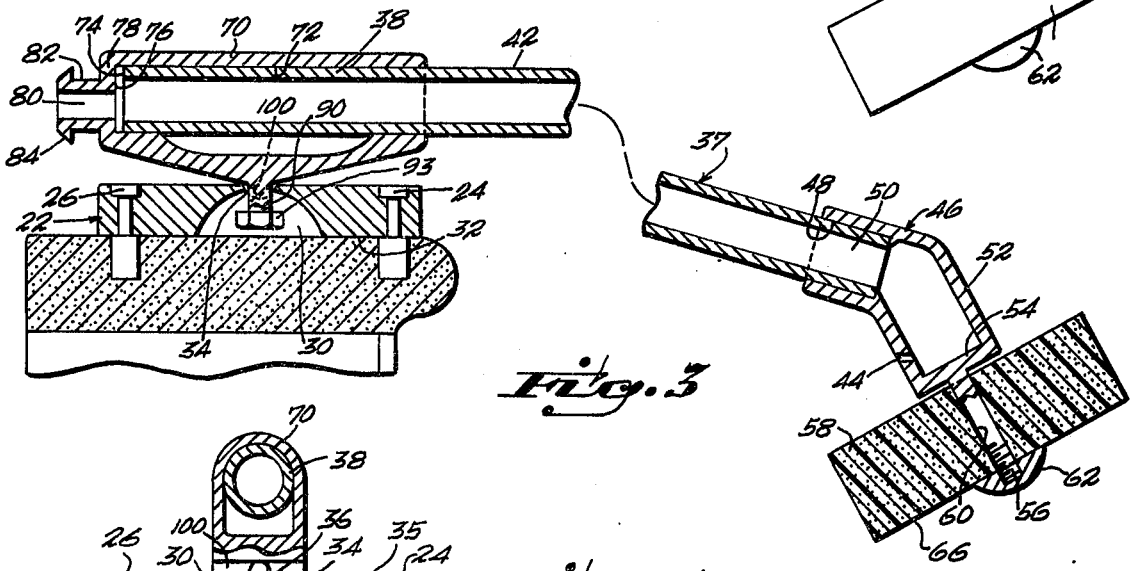
FIG. 3 is a view similar ro FIG. 2 in cross section.
Figure 4:
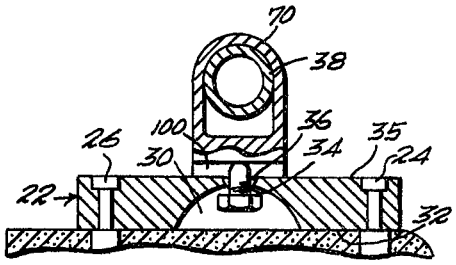
FIG. 4 is a vertical view in cross section taken on a separate plane of FIG. 3.

With reference to FIG. 3 it can be seen that the nut 93 is engaged on the bottom end portion of stud 90 to provide a sufficient stud length thereabove to permit the arm to be manually, vertically lifted until the nut 93 engages the surface of hollow 30 whereupon the rib 100 is free of groove 36. The arm 37 may then be rotated to the position of FIG. 4 which corresponds with the dotted line position 30' of FIG. 1.

Because the water level of the pool will vary somewhat, and consequently the float will cause the distal terminal end zone to move upwardly or downwardly to adjust for this, the arm will flex somewhat; and it is preferred that the pivot means be of a construction such that it will respond to this movement. In the illustrated preferred embodiment, see FIG. 2, the upper face of the support 22 with the groove 36 coacts with the knife edge 102 to act as a fulcrum and the length of the pivot pin 90 between the keeper nut 93 is such that, when the arm is swung to the dotted line position shown in FIG. 1, the knife edge 102 will climb out of the groove; and that when in the position shown in FIG. 2, the knife edge permits a range of tilting adjustment in response to the changes of water level in the pool.

What is claimed is:

1. For mounting to the edge of a pool above the normal water level of the pool, a device for urging floating debris on the water surface toward a skimmer having an opening at the normal waterline, said device comprising, an elongate tubular arm having:

a proximal end zone including means to connect to a waterflow supply through the arm to the distal end zone, means to mount the proximal end zone to the pool edge, said tubular arm including an intermediate zone extending outwardly and downwardly from said proximal end zone, and having a distal end zone below the proximal end zone and above the normal waterline of the pool, and said distal end zone having an opening facing toward said proximal end zone, said means to mount including a base and fastener means to connect the base to the pool edge, and vertical pivot means connecting the proximal end zone of the tubular arm to said base to permit a swinging movement of the arm about the axis of said pivot means.

2. The device as set forth in claim 1 wherein said means to mount includes a fitting on the proximal end zone.

3. The device as set forth in claim 1 wherein float means are provided for the distal end zone and means to connect the float means to the distal end zone.

4. The device as set forth in claim 3 wherein said means to mount includes a fitting on the proximal end zone.

5. The device as set forth in claim 2 wherein said pivot means extends downwardly from said fitting and including means to captivate the pivot means for rotation with respect to said base.

6. The device as set forth in claim 5 wherein said base includes a dome-shaped hollow in a bottom surface thereof comprising said means to captivate, a transverse groove in a top surface thereof and a through hole, bisecting said groove, opening into said hollow.

7. The device as set forth in claim 6 wherein said pivot means comprises a pivot pin extending downwardly through said through hole from said fitting and into said hollow, and a nut engaged on a screw-threaded lower end of said pivot pin, with said hollow, in a position to permit a limited amount of vertical movement of said fitting and arm relative to said base.

8. The device as set forth in claim 7 including a transverse rib on the bottom of said fitting, normally engaged in said groove in a first position and disengaged therefrom in a second position.

9. The device as set forth in claim 8 wherein said rib is generally triangular in cross sectional configuration to define a bottom knife edge to engage in said transverse groove.

* * * * *